United States Patent [19]

Shih

[11] Patent Number: 4,515,538

[45] Date of Patent: May 7, 1985

[54] CEILING FAN

[75] Inventor: Hung Y. Shih, Tainan, Taiwan

[73] Assignee: DeGeorge Ceilings, Inc., Clearwater, Fla.

[21] Appl. No.: 540,176

[22] Filed: Oct. 7, 1983

[51] Int. Cl.[3] ..... F04B 21/00

[52] U.S. Cl. ..... 417/572; 248/343; 248/667; 248/675; 415/62; 416/5; 416/246

[58] Field of Search ..... 417/423 R, 424, 360, 417/361, 12, 352, 353, 354, 44, 45; 415/121 B, 121 G, 61, 62, 66, 210; 416/247 R, 5, 126, 170 R, 170 C, 246; 248/666, 317, 324, 343, 675, 674, 637

[56] References Cited

U.S. PATENT DOCUMENTS

| | | | |
|---|---|---|---|
| 866,292 | 9/1907 | Meston | 416/5 |
| 1,396,654 | 11/1921 | Newman | 248/343 |
| 2,954,198 | 9/1960 | Lindberg et al. | 416/246 X |
| 2,967,928 | 1/1961 | Wolar | 248/343 X |
| 3,963,382 | 6/1976 | Patton | 415/121 G |
| 4,064,427 | 12/1977 | Hansen et al. | 417/424 X |
| 4,123,197 | 10/1978 | Keem et al. | 417/423 R |
| 4,341,151 | 7/1982 | Sakamoto | 416/247 R |
| 4,365,930 | 12/1982 | Ogura et al. | 415/61 |
| 4,457,672 | 7/1984 | Ogura et al. | 417/423 R |

*Primary Examiner*—Edward K. Look

*Attorney, Agent, or Firm*—Duckworth, Allen, Dyer & Pettis

[57] ABSTRACT

An electric ceiling fan of minimum practical axial depth for conserving needed head room includes a wheel-like frame; a fan motor nested therein; a fan blades assembly nested around and driven by such motor; a shallow support adapted to be attached directly to a ceiling; shallow hanger arms pivotally suspending the frame from the support for generally varying the air flow; a shallow, air pervious upper guard enclosing the motor and fan blades assembly; a step motor nested in the frame beneath the fan motor; a thin air pervious lower guard nested within the frame, driven by the step motor in the same direction as the fan blades assembly, but at much lower speed, and having radially spaced parallel vanes directing the downwardly flowing air in both axial and outwardly inclined, slowly revolving columns, for distributing the air over a wider area, while avoiding excessive air flow and "dead spots" beneath the fan; and a control mechanism including a separate switch for operating the step motor independently of the fan motor, a multi-position switch for stopping and selectively operating the fan motor at different speeds, a thermal switch for stopping the motors to avoid overheating, and a timer for both stopping and actuating the motors for continuous as well as predetermined periods of operation.

24 Claims, 7 Drawing Figures

Fig. 1.
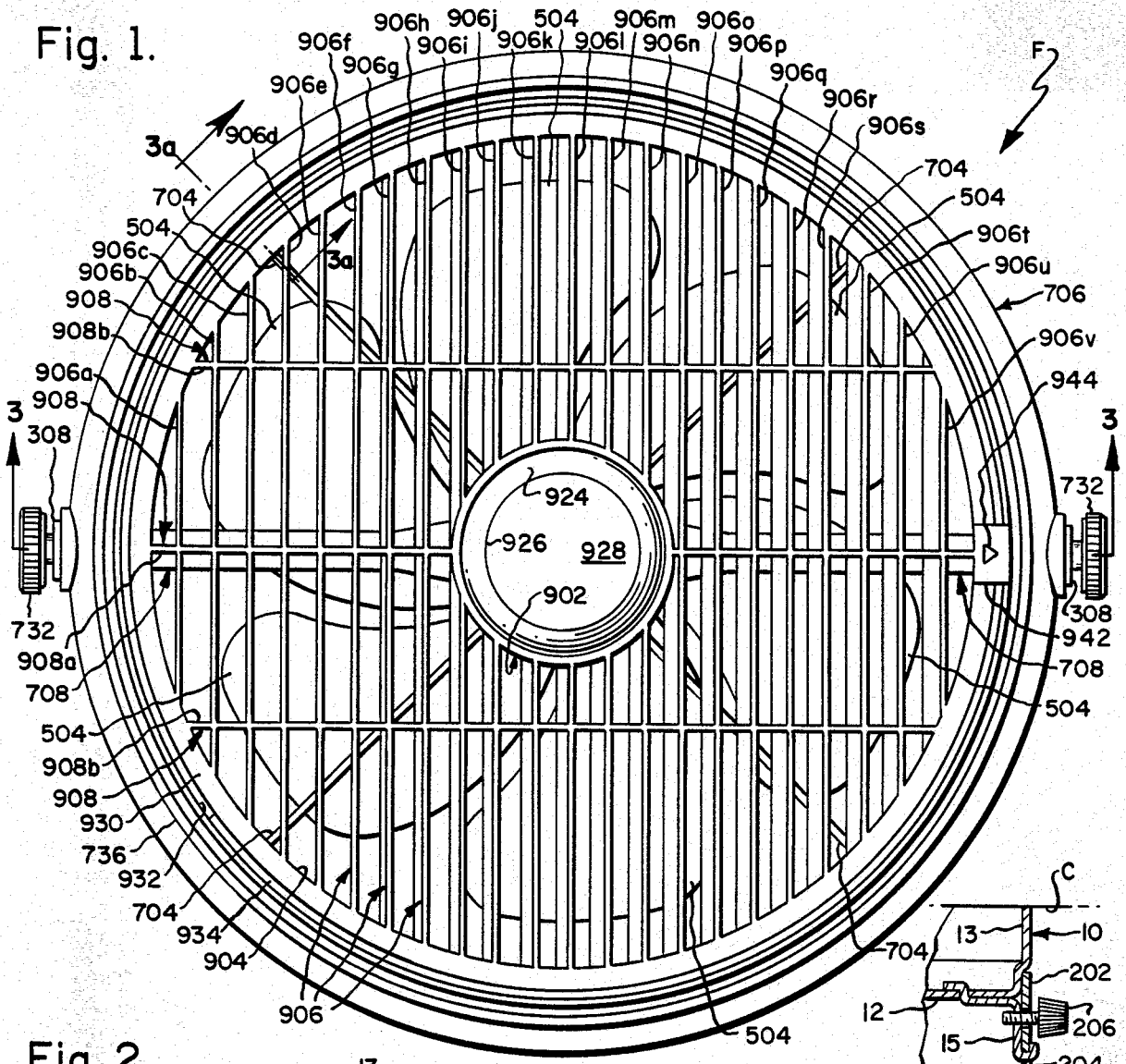
Fig. 2.
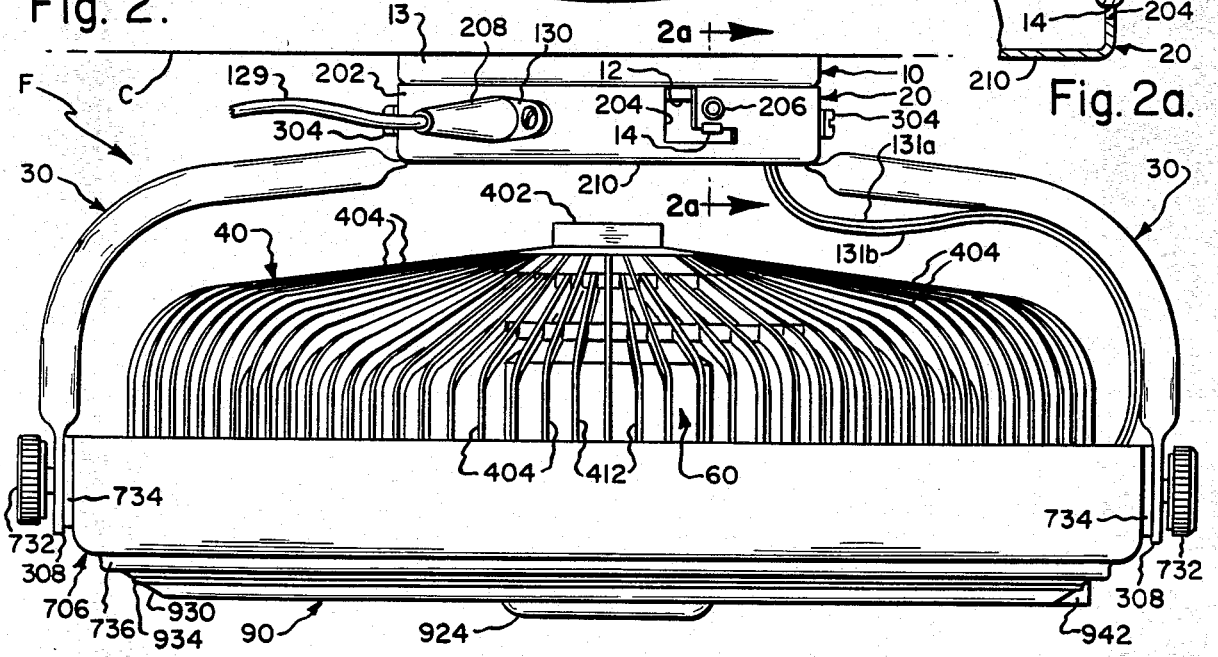
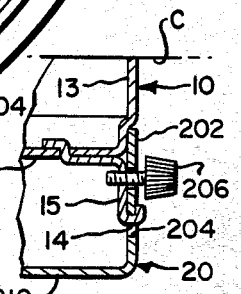
Fig. 2a.

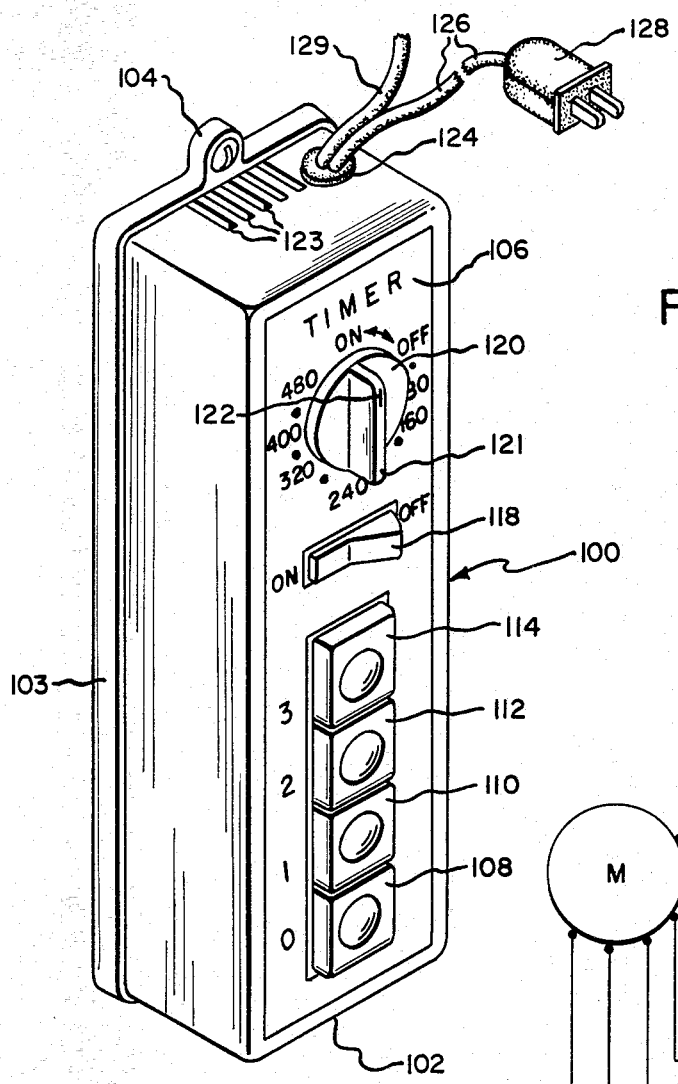
Fig. 4.
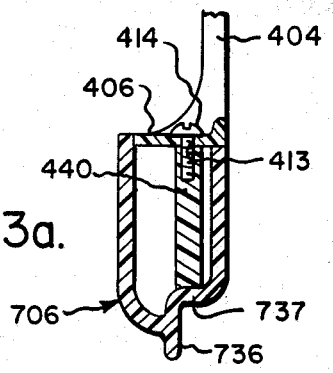
Fig. 3a.
Fig. 5.
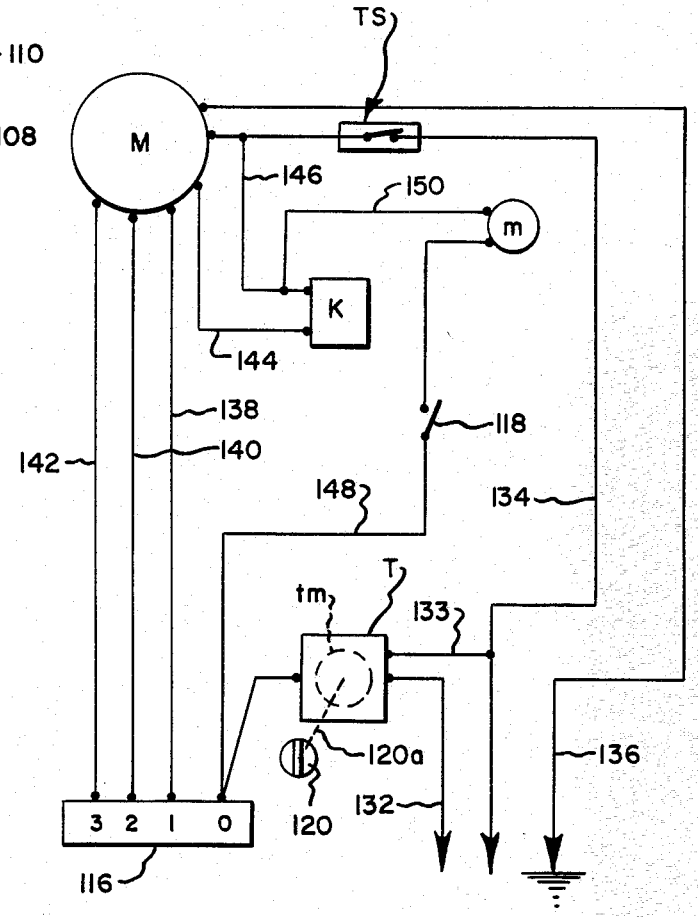

CEILING FAN

BACKGROUND OF THE INVENTION

1. Field of the Invention

This invention relates to electric fans, and more particularly to a new and improved ceiling fan.

2. Prior Art

Ceiling fans have been used for many years for air circulation purposes in residential, commercial and industrial buildings. More recently, the use of such ceiling fans has become popular in mobile homes, particularly in the warmer climates, such as Florida. At the same time, the typical fan construction, wherein the rotating blades are arranged in tandem with the drive motor, creates a problem, because it takes up valuable head room which is at a premium in this type of structure.

Likewise, such installations present problems of facial removable attachment to the ceiling in close proximity thereto, while providing adequate space for air flow; adjustment of air flow amount and direction; together with suitable control of the operation, duration and speed of fan blade rotation, as well as safety measures providing for shutoff to prevent fan overheating, and for protection against injury while handling the fan during installation, removal, repair, replacement, adjustment and operation. While various attempts have been made in the prior art to solve one or more of these problems, such attempts have not been completely successful.

For example, it was quite popular a number of years ago to provide what is known as an electrolier (a combined ceiling fan and electric light fixture). A visit to any electrical store will reveal that such electroliers are becoming popular once again. However, their design is hardly such as to maximize headroom by minimizing over-all fan length, because usually they are designed for positioning over a table, such as in the dining room of a home, wherein headroom is not all that important.

The illustrative prior inventions endeavoring to reduce overall fan containing fixture length are found in U.S. Pat. Nos. 585,250; 1,115,479 and 1,445,402. The '250 patent discloses an electrolier, wherein the large fan blades are mounted around the electric drive motor. However, the motor must be mounted on an elongated rod suspended from the ceiling, and the device includes below the unguarded fan blades a substantially axially elongated fixture for supporting a number of light bulbs. Likewise, in FIG. 3 of the patent, the lighting fixture is mounted above the unguarded fan blades, which are arranged in tandem with the drive motor, at the lower end of an elongated housing mounted on the depending ceiling rod. Obviously, this patent does not even contemplate the conservation of headroom.

The '479 patent also discloses an electrolier wherein a number of motors and unguarded fans arranged in tandem are mounted around a concave support attached to the ceiling, such support terminating in its lower end in a large light fixture. While this overall structure does not project to the same extent below the ceiling as the previous patented construction, it is of a rather bulky design and clearly does not maximize headroom.

In the '402 patent, the unprotected fan blades, which are mounted around the drive motor casing are designed to "disappear" by folding into the space between an upper casing depending from an elongated rod fixed to the ceiling and a lower fixture supporting a variety of light bulbs. Once again, this patented design is not concerned with maximizing headroom.

Additional prior art examples of electroliers are found in U.S. Pat. Nos. 866,292 and 2,119,398. The fan of the '292 patent is of skeletal global or spherical design, adapted to be secured to the usual rod suspended from the ceiling, and within such skeletal structure, the rotating fan blades are mounted above the drive motor. In addition, the skeletal structure is decorated externally by the addition of ornate light fixtures arranged both laterally and axially, as in FIG. 2 of the patent. Clearly, conservation of headroom is not suggested by this patent either. As for the '398 patent, the unguarded fan blades are located at the upper end of the motor casing, which depends from an elongated tubular support suitably secured to the ceiling, and arranged below the motor is a light fixture. Certainly this patent is not concerned with saving headroom either.

Of all the prior art patents referred to above, only the '479 patent discloses a mechanism for adjusting or controlling air flow direction. However, this mechanism is somewhat complicated in that speed reducers are required for revolving the fans around the depending light fixture. Moreover, none of the patented devices referred to above discloses the desirable features of facile removable attachment to a ceiling, in close proximity thereto; simple operation and/or adjustment of the fan itself for controlling and varying air flow direction; safety features such as shutdown to prevent overheating, and guards substantially completely protecting against manual contact with the rotating fan blades; as well as electrical control means for determining fan operation, duration, speed and cutoff, together with quantity and direction of air flow; especially in combination with fan structure of such compact design as to reduce its overall axial length or depth to the practical minimum, for maximizing headroom.

SUMMARY OF THE INVENTION

Accordingly, a general primary objective of the present invention is to provide a new and improved ceiling fan which is so constructed and designed as to overcome the various deficiencies in the aforesaid prior art. To this end, the inventive electric ceiling fan includes fan motor means and rotatable fan blade means mounted around and adapted to be driven by such motor means, wherein the improvement comprises: wheel-like frame means mounting such motor means; support means adapted to be attached to the ceiling; hanger arm means connecting such support means and frame means; air pervious upper guard means mounted on such frame means and enclosing such fan blade means and motor means, while permitting air flow to such fan blade means; step motor means mounted on such frame means; air pervious lower guard means mounted on and adapted to be driven by such step motor means beneath such frame means and including vane means for controlling air flow direction from such fan blade means; and control means adapted to be connected across a power source and including switch means having electrical connections to such fan motor means and step motor means for energizing and deenergizing the same; such fan having a maximum overall axial depth, from such support means to such lower guard means inclusive, of not more than about 10 inches, for maximizing headroom.

Another objective is to provide such fan wherein the overall diameter to axial depth ratio is not less than about 1.8/1 for adequate air flow volume and cooling area coverage at acceptable fan motor speeds and tolerable noise levels, and preferably such maximum overall axial depth is not more than about 9 inches, while such overall diameter to axial depth ratio is not less than about 2/1, for such purposes.

A further objective is to provide such fan wherein such frame means include a central hub, an outer ring, and radial spokes connecting such hub and ring; such hub having a lower end wall and an upper peripheral wall defining a relatively shallow and upwardly open cup-shape receiving such step motor means removably mounted on such end wall; such outer ring supporting such upper guard means and being pivotally connected to such hanger arm means for adjusting the position of such fan relative to the ceiling and thereby vary the general air flow-direction; such outer ring being of hollow and upwardly open, generally channel-shaped cross-section and including upstanding internally threaded socket means for engaging threaded fasteners removably securing such upper guard means over the open upper end of such outer ring; and at least one of such spokes housing certain of such electrical connections passing through such upper guard means and outer ring to such fan motor means and step motor means.

An additional objective is to provide such fan, wherein such support means include a circular base plate adapted to be attached directly to the ceiling, and a circular adaptor removably connected to such hanger arm means; such base plate and adaptor having lower end walls and upper peripheral walls defining shallow and upwardly open, complementary shapes, and inter-engagable means for removably securing the upper peripheral wall of such adaptor against the lower end wall of such base plate, which lower end wall is reduced for nesting within the upper peripheral wall of such adaptor; such inter-engagable means including diametrically opposite bayonet slots extending through the upper peripheral wall of such adaptor and rotatably engagable with the upwardly open outstanding hooks on struts depending from the lower end wall of such base plate, and threaded fastener means passing through the upper peripheral wall of such adaptor and engagable in internally threaded openings in such struts.

Yet another objective is to provide such fan, wherein such hanger means are of relatively shallow configuration and include a pair of elongated tubular members extending radially outwardly and downwardly from such support means to such frame means, with each of such tubular members including an upstanding flattened upper end removably secured within such support means and a flattened lower end overlapping and removably secured to such frame means.

A still further objective is to provide such fan, wherein such upper guard means is of relatively shallow configuration and includes a central hub, an outstanding annular flange removably secured to such frame means; a plurality of closely spaced elongated ribs extending radially outwardly and axially downwardly from such hub to such flange; at least one reinforcing ring intermediate such hub and flange, and a plurality of shorter ribs extending between such elongated ribs from such ring to such flange.

Still another objective is to provide such fan, wherein such lower guard means is of thin, disk-like configuration and includes a central hub, and an outer ring connected to the hub by certain ones of a series of radially spaced and generally parallel, elongated air flow control vanes spanning opposite inner peripheral portions of such outer ring, and by at least one elongated diametral reinforcing rib extending transversely across such vanes; such central hub including a disc wall and an upstanding peripheral flange freely nesting around the lower end wall of such hub of such frame means, on which lower end wall is removably mounted such step motor means having a rotatable drive shaft freely passing downwardly through a central opening in such lower end wall; such lower guard means also includes a drive member having a disc washer removably secured on such disc wall and provided with an externally threaded hollow stub shaft passing downwardly through a central opening in such disc wall and receiving such drive shaft, which is removably fixed therein to space such disc washer slightly from such lower end wall for free rotation of such lower guard means relative to such frame means, to vary the air flow from such fan blade means through such vanes; such peripheral flange also projects downwardly beyond such disc wall, and such lower guard means also includes a hub cap of shallow and upwardly open cup-shape and provided with an upstanding internally threaded collar engaged over such stub shaft in a direction opposite to the rotation of such lower guard means, for tightening the upper end of such hub cap against such disc wall during such rotation; and such outer ring of such frame means has a peripheral wall portion protruding downwardly around a radial peripheral wall portion to define a recess in which is freely nested such outer ring of such lower guard means, with the latter ring being provided with peripherally spaced upstanding lugs spaced slightly below such radial wall portion for guiding the rotation of such lower guard means relative to such frame means.

A still further objective is to provide such fan, wherein such fan motor means rotates such fan blade means at high speed as compared to the low speed of such lower guard means being rotated by such step motor means in the same direction as such fan blade means; with a number of such vanes adjacent one peripheral portion of such outer ring of such lower guard means being arranged with their sides extending generally axially to create a generally axial column of air flowing downwardly from such fan blade means, and the remainder of such vanes being arranged with their sides inclined toward the opposite peripheral portion of such outer ring of such lower guard means to create a column of air flowing downwardly and outwardly from such fan blade means, with each of such columns slowly revolving with such lower guard means to distribute the air over a wider area, while eliminating any excessive flow or "dead spots" directly beneath such fan, and with such opposite peripheral portion of such outer ring of such lower guard means being provided on its lower surface with means indicating the position of such inclined vanes and the column of air flowing downwardly and outwardly therefrom.

Still another objective is to provide such fan, wherein such switch means include a separate switch for energizing and deenergizing such step motor means independently of such fan motor means, and a multiposition switch for deenergizing such fan motor means and for selectively energizing such fan motor means at different speeds, viz. high, intermediate and low speeds respectively; and with such control means including a normally closed, thermal switch connected in circuit with both of such motor means and automatically openable upon a predetermined temperature being reached to deenergize both of such fan motor means, and thereby prevent overheating thereof, as well as timer means connected in circuit with such fan motor means and step motor means for deenergizing both of such motor means and for energizing both of such motor means for continuous as well as predetermined periods of operation, such timer means having timer motor means and selective multiposition timer switch means operatively associated with and drivable by such timer motor means, such timer switch means having one position for deenergizing all three of such motor means, another position for deenergizing such timer motor means while energizing both of such fan motor means and step motor means for continuous operation, and still other positions for energizing all three of such motor means for predetermined periods of operation, until driven by such timer motor means to such one position.

A still further objective is to provide such fan, wherein such frame means include an outer ring of hollow and upwardly open, generally channel-shaped cross-section and having adjacent each diametrically opposite point of attachment to such hanger arm means, a pair of internal and upstanding, spaced radial walls, a rectangular nut continued transversely between such radial walls against rotation, and a radial bolt passing through such hanger arm means and the outer periphery of such ring into threaded engagement with such nut to mount such frame means on such hanger arm means, for pivotally adjusting the position of such fan relative to the ceiling and thereby vary the general air flow direction.

Additional objects and advantages of the invention will become evident upon consideration of the following detailed description and accompanying drawings, wherein:

BRIEF DESCRIPTION OF THE DRAWINGS

FIG. 1 is a front or bottom view of a ceiling fan constituting a preferred embodiment of the invention;

FIG. 2 is a side elevation thereof, as installed;

FIG. 2*a* is an enlarged fragmentary section taken substantially along line 2*a*—2*a* of FIG. 2;

FIG. 3*a* is an enlarged fragmentary section taken substantially along line 3*a*—3*a* of FIG. 3;

FIG. 4 is a perspective view of the electrical control mechanism, and

FIG. 5 is a schematic wiring diagram including such control mechanism and electrical components of the fan.

DESCRIPTION OF THE PREFERRED EMBODIMENT

Figure 3:
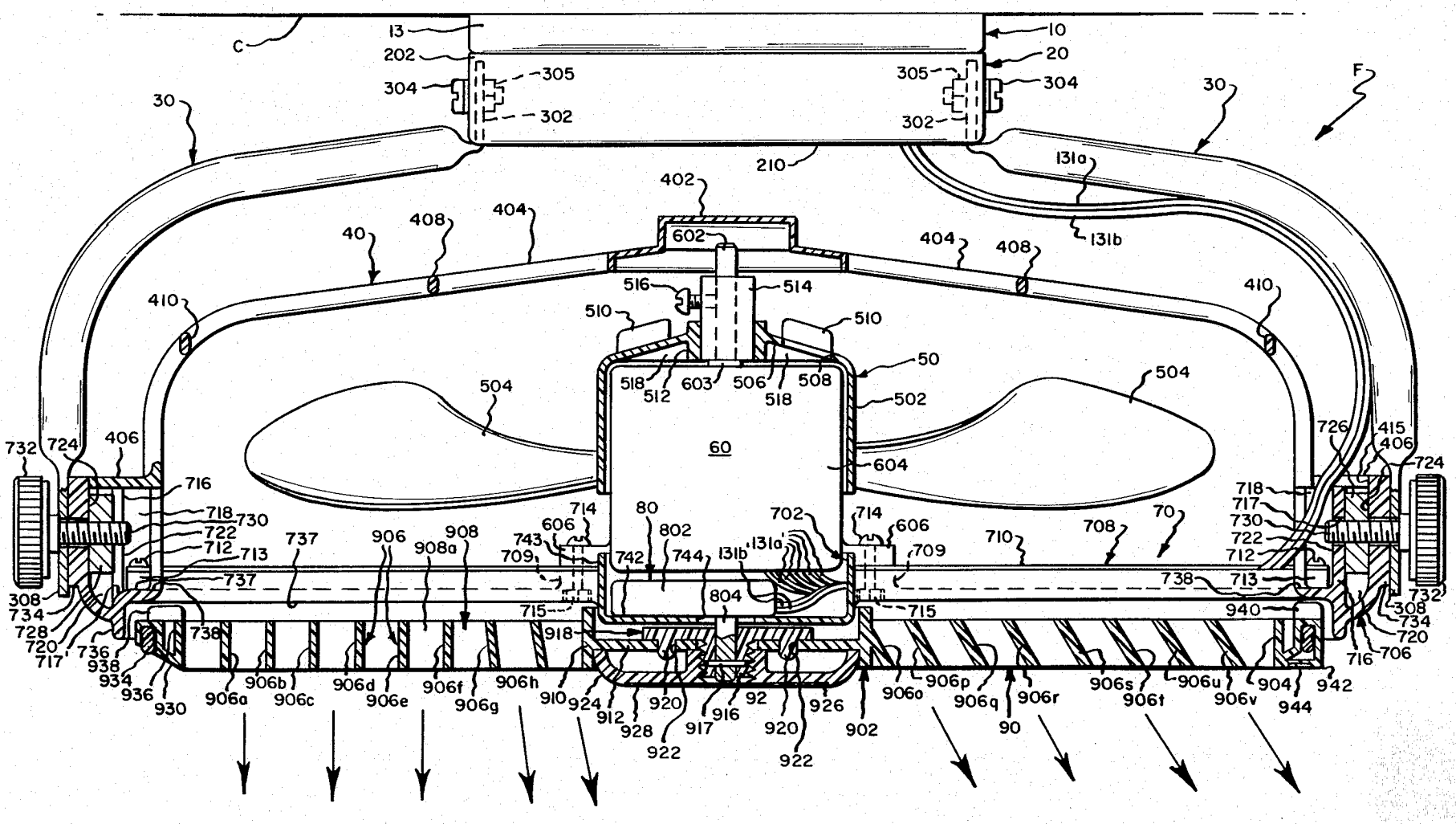
FIG. 3 is an enlarged section taken substantially along line 3—3 of FIG. 1.

Referring to the drawings, and particularly FIGS. 1–3, a preferred embodiment of the inventive ceiling fan is generally indicated at F, as installed on a wall such as ceiling C (FIG. 2 and 3). The inventive F generally includes the following components: base plate 10; adaptor 20; hanger arms 30; rear guard 40; fan blade assembly 50; fan blade drive motor assembly 60; front frame 70; front guard drive or step motor assembly 80; front guard 90, and electrical control mechanism 100 (FIG. 4).

Base Plate and Adaptor

As best seen in FIGS. 2 and 3, the facile removable attachment to a wall such as ceiling C, is accomplished by the engagement between circular base plate 10 and circular adaptor 20, both preferably made from strong light weight material such as sheet metal, and suitably formed to complementary upwardly open, shallow cup-shape, with the open upper peripheral wall 202 of adaptor 20 nesting over the reduced bottom or end wall 12 beneath upper peripheral wall 13 of base plate 10.

This bottom wall also is provided with the usual openings (not shown) for ready attachment to the ceiling wall C and, if needs be, access to a power source (not shown). In addition, base plate 10 is provided with diametrically opposite and outstanding, upwardly open retainer hooks 14 on struts 15 (only one being shown in FIGS. 2 and 2*a*) suitably secured to and depending from bottom wall 12 for removable engagement with adaptor 20. The latter, in turn, is provided with diametrically opposite L shaped or bayonet slots 204 (only one being shown) for suitable facile engagement with hooks 14, simply by relative rotation. This subassembly is removably secured together by threaded fasteners such as knob-bolts 206 (only one being shown) passing through upper peripheral wall 202 and suitably threadedly engaged through internally threaded openings in struts 15. Adaptor 20 likewise is provided with a suitable female plug 208 for connection to the male plug 130 of cable 129 connected to electrical control mechanism 100 (FIG. 4). Moreover, adaptor 20 is provided with an opening (not shown) through its lower end or bottom wall 210 for the passage of cables 131*a*, 131*b* carrying the wires connecting fan drive motor assembly 60 and lower guard drive motor assembly 80 respectively to plug 208 and across capacitor K (not shown except schematically in FIG. 5) suitably secured to base 210 of adaptor 20.

Thus, headroom is maximized by the shallow construction and nested relationship between base plate 10 and adaptor 20, while the former is readily attached to ceiling C, and the latter is easily secured to, as well as removable from the former by virtue of the bayonet slot, hook and knob-bolt connection.

Hanger Arms

Continuing with FIGS. 2 and 3, fan F is mounted in close juxtaposition beneath adaptor 20 by a pair of elongated, tubular, and preferably metal, shallow hanger arms or members. At their upper ends, hanger arms 30 are flattened and bent upwardly to provide upstanding distal flanges 302 passing through peripheral slots (not shown) provided in base 210 of adaptor 20, and suitably secured in place by threaded fasteners such as bolts 304 and nuts 305. At their lower ends, arms 30 likewise are flattened to provide downwardly extending lower distal flanges 308 for adjustably securing fan F to hangers 30, as will be explained in detail below.

Hence, it will be evident that shallow, downwardly curved hanger arms 30 not only provide suitable support for the fan, but also help to maximize headroom by locating fan F as close as practically possible to ceiling C, while at the same time allowing adequate space for the entry of circulating air from above the fan.

Rear Guard and Front Frame

As best seen in FIGS. 2 and 3, fan F also includes the subassembly of rear fan guard 40 and front frame 70, both preferably molded in one piece from suitable rigid plastic material. The former is composed of a hollow cylindrical central hub portion 402 connected by a multiplicity of radially outwardly extending ribs 404 curving downwardly at their outer ends and terminating at a lower or front and outstanding, annual peripheral flange portion 406, thereby providing an overall, shallow conical and cylindrical configuration of open or networklike design, strengthened by inner and outer concentric rings, 408, 410 respectively. As a matter of fact, arranged between ribs 404 and extending from inner concentric ring 408 through outer concentric ring 410 as well as connected to lower flange 406 are additional shorter ribs 412 complementery to longer ribs 404 insofar as they are curved downwardly toward their lower or front ends. This construction gives additional strength and rigidity to the lightweight rear guard 40 which, while protecting against accidental entry of fingers, provides a more than adequate open area for free air flow through fan F. Likewise, at suitable intervals around its periphery, flange 406 is provided with through holes 413 (only one being shown in FIG. 3*a*) for reception of fasteners such as screws 414 which are utilized to removably secure flange 406 and rear guard 40 to front frame 70, as well as a peripheral slot or opening 415 for passage of cables 131*a*, 131*b*, as referred to below.

In actuality, front frame 70 takes the form of a spoked wheel, including hollow and cylindrical central hub 702, connected by six radial spokes 704 (only four being shown in FIG. 1, the other two radial spokes being hidden by front guard 90), with a hollow outer ring or annulus 706. In addition, and as best seen in FIG. 3., two enlarged and diametrically aligned spokes 708 are provided. These enlarged spokes are of upwardly or rearwardly open, channel-shaped cross-section for the reception of elongated metal reinforcing members 710, which likewise are of channel-shaped cross-section, but opening downwardly or forwardly, and are suitably secured in place at their outer ends by screws 712 passing through the flat protruding ends of members 710 into tapped sockets 713 provided within ring 706. Similar attachments are made at the flat protruding inner ends of members 710 by screws 714 passing through both members 710 and bosses 709 formed within the inner ends of spokes 708, and secured by nuts 715 recessed within such spokes. Screws 114 actually perform a double function, as referred to below. Further, the upper wall of the right one (FIG. 3) of members 710 is provided with a through opening near its outer end for housing cables 131*a*, 131*b* connecting motor assemblies 60 and 80 respectively with the aforedescribed components in adaptor 20, with such cables passing through such member 710, with five lead wires 131*a*′ leading to fan drive motor assembly 60 and a pair of lead wires 131*b*′ leading to step motor assembly 80, as clearly shown.

In addition, hollow outer ring or annulus 706 of front frame 70, which is shown as being of enlarged and upwardly open, channel-haped cross-section, is strengthened by a series of peripherally spaced, radial wall sections or dividers (not shown). Further, adjacent each diametrically opposite point of attachment to hanger arms 30, ring 706 is provided with a short intermediate peripheral divider wall 716 having a through opening 717 (right) or slot 717 (left) and connected to pairs of closely spaced inner and more widely spaced outer, short radial walls 718, 720 respectively (only one of each pair being illustrated), thereby forming smaller inner and larger outer compartments 722 and 724 respectively, at each outer end of each enlarged channelspoke 708. Each inner compartment 722 is open at its inner end for the reception of the protruding flat outer end of each reinforcing channel member 710, and is provided with the aforesaid tapped socket or boss 713 for engagement with screw 712. Each outer compartment 724 provides room for an enlarged rectangular nut 726 (right) 728 (left) engaging the corresponding stud bolt end 730 of adjusting knob 732, with each bolt passing through an opening in the thickened disc-shaped outer wall portion 734 of hollow ring 706. Each of the outer faces of portions 734 forms a smooth, flat bearing surface for pivotal movement of fan F with respect to each hanger arm 30, each lower flattened flange 308 of which is perforated and also mounted over each bolt 730 passing freely therethrough.

In addition, ring 706 is provided with a peripheral wall portion 736 protruding downwardly around an inner radial wall portion 737 to define a recess in which is freely nested lower guard 90, also contributing to the overall axial compactness of fan F. Likewise as best shown in FIG. 3, the opposite inner peripheral wall portions of ring 706 are provided with upwardly open slots 738 forming the aforesaid openings in inner compartment 722 for passage of the outer ends of members 710.

At the right side, this slot together with peripheral slot 415 in flange 406 facilitate passage of cables 131*a*, 131*b* while at the left side, flange 406 closes both compartments 722, 724 at the top. As best seen in FIG. 3*a*, flange 406 is removably secured to front frame 70 by a series of peripherally spaced and upstanding tapped bosses 740 (only one shown) molded within ring 706 and a corresponding number of screws 414 (only one shown), threadedly engaged therein.

At its inner end, each channelspoke 708 terminates in the aforementioned, relatively shallow and upwardly open, cup-shaped central hub 702 formed by lower end wall 742 and upper peripheral wall 743, the former being provided with a central through opening 744 for a purpose to be described below.

As now will be seen, such subassemblies 40 and 70 of fan F readily can be assembled, and disassembled, as well as adjustably pivoted relative to hanger arms 30 by turning knobs 732, in order to provide a variety of angular positions of the fan, in addition to the vertical position illustrated in FIG. 3, for varying the principal or general overall direction of air flow (indicated by the arrows).

Fan Blades Assembly

Continuing with FIG. 3, the rotatable fan blades subassembly 50 preferably is molded in one piece from suitable rigid plastic material also, and preferably includes a central, and downwardly or forwardly open, cup-shaped, hollow hub 502, the front or lower cylindrical portion of which is arranged freely over motor assembly 60 for optimum axial compactness, and mounts a series of six (FIG. 1) peripherally spaced and suitably inclined, fan blades 504 for impelling the air flow through the fan. At its upper or rear end, hub 502 is provided with a relatively shallow conical portion 506 having, spaced around its periphery, suitable openings 508 (only one being shown) and struck up directional louvers 510 for air flow control through hub 502 and around drive motor assembly 60, especially for cooling the latter. At its inner or upper end, shallow conical portion 506 terminates in a collar 512 press fit or otherwise suitably fixed over a hollow metal bushing 514 provided with a set screw 516, and has internal reinforcing ribs 518, all for a purpose to be described below.

Fan Motor Assembly

This entire fan blades assembly 50 is driven by motor assembly 60 through drive shaft 602 fixed within bushing 514 by set screw 516. Actually, only housing 604 of motor assembly 60 is shown in FIG. 3, in a somewhat schematic manner, it being understood that such housing could be provided in two or more parts suitably secured together, for each of access in the repair and/or replacement of the actual motor itself, which is schematically shown at "M" in FIG. 5.

As also seen in FIG. 3, the front of motor assembly housing 604 is provided with a pair of outstanding radial flanges 606, which are secured to front frame 70 by the aforesaid threaded fasteners 714, 715, which also serve to secure the inner ends of metal reinforcing members 710 in place, as noted above.

It is now evident that the arrangement of rear guard 40, fan blades assembly 50 and drive motor assembly 60 cooperate together, and with the sub-assemblies of hanger arms 30, adaptor 20 and base plate 10 to axially foreshorten the over-all length of fan F to the practical minimum, while at the same time permitting sufficient space for intake air circulation around hanger arms 30 and through rear guard 40. In this respect, note particularly the hollow recessed construction of rear guard hub 402, freely receiving motor drive shaft 602, as well as the substantially flush relationship between the lower or front ends of bushing 514, collar 512 and strengthening flanges 518 of shallow conical portion 506, very close to but preferably slightly spaced above the rear end of motor housing 604 by a shoulder 603 on shaft 602 for free rotation.

Thus, the mounting of fan blades 504 around drive motor 60; the very close relationship between the substantially flat rear or upper end of motor housing 604 and the substantially flush lower or front ends of the aforesaid fan blade hub components; the close relationship between the rear or upper end of the fan drive shaft 602 freely nested within the recessed central hub portion 402 of rear guard 40; with the shallow arcuate nature of hanger arms 30 as well as that of rear guard ribs 404, 412; together with the close nesting relationship between shallow adaptor 20 and shallow base plate 10 directly secured to ceiling wall C, all cooperate to provide the minimum practical overall axial length or depth of fan F. As a consequence, maximum practical headroom is provided and this is of great importance in mobile homes, as well as in installations where height is necessarily limited, such as mobile living structures forming part of or attached to an automotive vehicle.

Front Guard and Drive

Returning once again to FIG. 3, fan F is completed by front guard 90 and front guard drive motor assembly 80. The latter is composed of a step motor "m" shown schematically in FIG. 5, with only the step motor casing 802 being illustrated schematically in FIG. 3, as nested and removably secured within hub 702 by any suitable means, such as upstanding pins (not shown) on lower end wall 742 passing through perforated flanges (not shown) on the motor casing. Such motor assembly 80 is provided with a downwardly or forwardly extending, axial drive shaft 804 passing freely through central opening 744 in base 742 of front frame hub 702 for driving engagement with front guard assembly 90, as described below.

As with the various components described above, front guard 90 also preferably is molded in one piece of suitable rigid plastic material, to form a thin disk-like member composed of a central hub 902 connected to an outer ring 904 by certain ones of a series of elongated vanes generally indicated at 906, and forming part of a grid or network spanning the opposite upper and lower inner peripheral portions of outer ring 904, as best shown in FIG. 1. The network is completed by three elongated and transversely extending reinforcing ribs generally indicated at 908. More specifically, the central diametral rib is designated as **908*a*, while the outer two slightly shorter ribs, which are parallel to and spaced on either side of central rib 908*a*, are designated at 908*b***.

Continuing with FIG. 1, there are a total of twenty-two vanes 906 extending transversely of ribs 908, and arranged in radially spaced parallel relationship with each other across the face of guard 90 between opposite left and right peripheral portions of outer ring 904, with a sub-total of seven (7) central vanes 906 contacting and connecting central hub 902 with the outer ring. However, as viewed in FIG. 1, such vanes are divided essentially into two groups, from left to right. The left group of six (6) vanes adjacent the left peripheral portion of ring 904 are arranged with their sides extending axially (i.e. parallel to the central fan rotational axis at the center of hub 902 and motor drive shafts 602, 804) for "straight" or axial air flow through front guard 90, and these vanes are specifically designated as **906*a* through 906*f*** as they increase in length from left to right.

As for the remaining vanes, they sub-total sixteen (16) in number, but are arranged so that their sides incline relative to the central rotational axis of fan F and increase in inclination from left to right (i.e. their sides increasingly face more toward the right opposite peripheral portion of ring 904 or transversely of the central rotational axis from left to right) for varying air flow direction downwardly and outwardly to the right as shown in FIG. 3. Thus, these vanes are specifically designated from left to right as **906*g* through 906*v***.

Returning to FIG. 3, front guard hub 902 includes an annular peripheral and axially extending flange 910 protruding forwardly or downwardly and rewardly or upwardly beyond a central disc wall portion 912, which is provided with a central through opening 914 down through which freely passes the externally threaded, hollow stub shaft or tube 916 of a molded rigid plastic drive member 917 having a disc washer 918, in turn provided with a number of peripherally spaced depending lugs 920 (only two being shown) passing downwardly through mating openings 922 (only two being shown) in hub wall 912. Suitably fixedly secured within stub shaft 916, as by cross pin 917, is drive shaft 804 of step motor assembly 80 nested within frame hub 702 on base 742, for rotating front guard 90 relative to front frame 70 of fan F, and thereby varying air flow direction around the face of the fan.

However, at this point it is to be noted that the upper or rear face of washer 918 is both smooth and flat and very close to, but slightly spaced from the flat bottom surface of base 742, as by cross pin 917, for free rotation of front guard 90 relative to front frame 70, with lugs 920 and the fixed relationship of stub tube 916 and drive shaft 804 ensuring direct, positive drive of outer guard 90.

As an example of the aforementioned variable air flow result, obtained by inventive fan F, assume that the fan blades 504 are rotating at relatively high speed or rpm, say in a clockwise direction (FIG. 1), while front guard 90 is rotating at a much lower rpm or speed in the same direction. This causes a rippling effect on the air flow, and thereby varies its direction, particularily with the changing rotative positions of the two groups of six (6) "axial" or "straight" vanes 906*a*–906*f* and sixteen (16) inclined or slanted vanes 906*g*–906*v*, so that in effect, two columns of air are produced, one flowing generally axially outwardly or downwardly from a wall such as ceiling C, and one generally slanted or inclined outwardly and downwardly (arrows, FIG. 3), with such columns slowly revolving with guard 90 around the floor or other area subject to the air flow. This variegated air flow effect distributes the cooling air over a wider area while eliminating any excessive flow or "dead spots" directly in front of or beneath fan F.

As also best shown in FIG. 3, a decorative hub cap 924 is provided, and preferably is molded into a shallow and upwardly or rearwardly open, cup-shape from suitable rigid plastic material. As such, hub cap 924 is provided with an internally threaded and rearwardly or upwardly extending, collar 925 engaged over stub tube 916, the threads of each being "left handed", so that as guard 90 rotates clockwise, such engagement tends to tighten the retention of hub cap 924, which nests at its upper or rear end snugly against disc 912 within flange 910, which also provides a nest for freely receiving front frame hub 702. Cap 924 also is provided with a recess or detent 926 in its front face for the reception of a decal 928 or other identifying label bearing indicia such as the manufacturer's logo etc.

Outer ring or annulus 904 of front guard 90 has an outwardly and rearwardly or upwardly bevelled front or lower surface 930 provided with a downwardly or forwardly open, outer annular groove 932 into which is snap-fit a split rigid plastic ring 934 of solid "figure eight" cross-section. The outer or lower surface of ring 934 projects slightly beyond bevelled surface 930 (as also seen in FIG. 1) and preferably is metallized for decorative purposes. Likewise, ring 904 is reduced in weight by an inner end upwardly or rearwardly open, annular reentrant groove 936, and at its rear or upper end, ring 904 also is provided with a number of peripherally spaced and upstanding, hollow lugs 938 (left) 940 (right) (only two being shown), the upper or rear surfaces of which are spaced slightly below the recessed front or lower wall portion 737 of frame ring 706 for guiding the free rotation of front guard 90 relative to front frame 70. In addition, as shown at the right of FIG. 3, guard ring 904 is provided with a raised front or lower boss 942, in the front surface of which is a recessed arrowhead 944 (FIG. 1), which preferably is of contrasting color, for indicating the position of the inclined vanes 906*g*–906*v* of front guard 90, and hence the inclined air flow column.

From the foregoing, it will be evident that, in addition to the interfitting or nesting, and shallow shape or configuration of the previously described cooperative components 10, 20, 30, 40, 50, 60 and 70; the relatively thin disk shape of the step motor assembly 80 and front guard 90, as well as the inter-fitting or nesting relationships, as exemplified by motor casing 802 within hub 702, such hub within flange 910; motor drive shaft 804 and stub tube 916 within collar 920; hub cap 924 within front guard flange 910, and front guard ring 904 within recessed front frame ring 706, all contribute significantly to substantial foreshortening of the overall axial fan length, and thereby maximize conservation of headroom, as desired.

Control Mechanism

Proceeding to FIG. 4, the electrical control mechanism is generally indicated at 100, and as including an elongated rectangular control box 102 preferably molded of rigid plastic material and provided at its outstanding peripheral base portion 103 with perforate lugs 104 at each end (only one lug being shown) for suitable securement to a wall or the like. On its recessed front face 106, box 102 is provided with the appropriate controls, namely buttons 108, 110, 112 and 114 corresponding to the indicated "0", "1", "2" and "3" positions of a four way switch (schematically shown at 116, FIG. 5), the "o" meaning "off" (i.e. deenergized), "1" meaning high speed, "2" meaning intermediate speed, and "3" meaning low speed, all of fan drive motor assembly 60 (FIG. 3), with the motor itself being shown at "M" in FIG. 5. Also positioned on front face 106 of control box 102 is an "on-off" switch 118 (also shown in FIG. 5) for energizing and deenergizing step motor "m" (FIG. 5) of step motor assembly 60 (FIG. 3).

At the top of front face 106 of control box 102 is a selective multi-position rotary switch or dial 120 having fingerhold portion 121 provided with position indicator or mark 122, and together with timer motor "tm" form part of timer T schematically shown in FIG. 5. The arrows on face 106 point to the continuous "ON" position and the "OFF" position with the various predetermined "ON" time duration positions being indicated around switch 120 by dots and numerals "80", "110", "240", "320", "400", and "480" respectively, standing for minutes up to and including four (4) hours respectively. Finally, at the upper end of control box 102, which upper end is provided with cooling air vents 123 (as is the lower end, not shown), an insulating washer or grommet 124 is provided for passage therethrough of cable 126 having male plug 128 for connection to the input and return sides of the power source (not shown), as well as cable 129 carrying the input and return lines to motor assemblies 60 and 80 respectively via plugs 130, 208 and cables 131*a*, 131*b* (FIGS. 2 and 3).

Although not shown in FIG. 4, a thermal cutoff switch TS, (schematically shown in FIG. 5) also is provided at any convenient location (not shown), and is considered as part of electrical control mechanism 100.

OPERATION

The schematic wiring diagram for electric control mechanism 100 and the components controlled thereby is depicted in FIG. 5. Thus, line 132 represents the input side of the typical 110–120 volts A.C. power source (not shown), while line 134 represents the return side, with line 136 representing ground.

As for timer T it is shown schematically in FIG. 5 as connected across input line 132 and output line 134 by line 133 and in circuit with both fan motor "M" by switch 116 and lines 138, 140 and 142, and with step motor "m" by line 148 and switch 118. Only the components necessary to an understanding of its operation by those skilled in the art are illustrated, namely switch 120 and timer motor "tm". Thus, switch 120 is shown by dotted line 120*a*, FIG. 5, as being operatively associated with and drivable by timer motor "tm". Hence, when switch 120 is set in the "OFF" position (FIG. 4), timer motor "tm" and both fan motor "M" and step motor "m" are deenergized, because the circuit is broken in timer T; when switch 120 is set in the continuous "ON" position (FIG. 4), timer motor "tm" is deenergized, while the circuit is completed through timer T for continuous energizing both fan motor "M" and step motor "m"; on the other hand, when switch 120 is set in any one of the remaining positions, such as "80" through "480" (FIG. 4), all three motors are energized, for the selected one of the various predetermined periods of operation, until switch 120 is driven by timer motor "tm" to the "OFF" position.

Thus, assuming the circuit is completed through timer T and switch 118 is open, current from line 132 flows through timer T to four-way switch 116, and out therefrom depending upon which one of the "0", "1", "2" and "3" switch buttons (FIG. 4) is depressed. Assuming "0" button 108 is depressed, the current to lines 138, 140, 142 is cut off, but not to line 148, which nevertheless is broken by open switch 118; hence, neither motor "M" (of fan drive motor assembly 60, FIG. 3) nor motor "m" (of step motor drive assembly 80, FIG. 3) is energized, with fan F thereby being deactuated. Assuming the "1" button 110 is depressed instead, current flows through line 132, energized motor "tm", timer T and line 133, as well as control switch 116 and line 138 to the input of motor "M", then through output line 134 and normally closed, thermal cut-off or shutdown switch TS, thereby energizing motor "M", which is of the variable speed, capacitance type, at the high speed or rpms, to rotate fan blades assembly 50 at top rpm for maximum air flow. Should the "2" button 112 be depressed, current flows through input line 140 for intermediate speed of motor "M" etc., while depression of the "3" button 114 energizes line 142 for slow or low speed operation of motor "M" etc.

Regardless of the speed selected for motor "M", current also flows continuously through the capacitance loop circuit composed of capacitor K and lines 134, 146, 144 to provide two-phase inductance motor "M" with a high torque for quick starting and acceleration to the pre-set speed, as well as smooth torque output and increased efficiency, enabling a lighter weight motor to be used.

Likewise, regardless of which "0", "1", "2" or "3" button is depressed, as long the circuit is completed through timer T, current flows from line 132 through line 148, closed step motor switch 118, across step motor "m" and thence through lines 150, 146 and 134. Of course, if switch 118 is open, step motor "m" is deenergized and front guard 90 (FIGS. 13) will not rotate to variegate columnar air flow, regardless of the speed of fan blades assembly 50 (FIG. 3). Thus step motor "m" is energized and deenergized by switch 118 independently of fan motor "M", even if "0" button 108 is depressed to deenergize motor "M", because current still flows from line 132 through line 148.

However, timer T and normally closed thermal switch TS effectively control the overall operation of fan F, because each is connected in circuit with both motors "M" and "m", as noted above. Therefore, if the circuit through either of these components is broken, entire fan F is deenergized, regardless of the condition of the rest of the circuitry. Accordingly, in order to prevent either or both motors from overheating, thermal switch TS, in return line 134, is set to automatically open upon the critical temperature being reached, and thereby shutdown or cutoff the entire fan operation, as a safety measure. Likewise, when timer motor "tm" is deenergized by moving switch 120 to the "OFF" position, either manually or by the preset time expiring, the circuit is broken in timer T, and entire fan F is deenergized. Accordingly, timer T performs an important function, not only from the energy conservation and user convenience standpoints, but also as an additional safety feature.

The following information is given in order to illustrate certain practical aspects of the invention. Each of motor "M" and "m", as well as timer T, capacitor K, thermal switch TS and switches 116, 118 are commercially available, as individual units, and therefore no further designation of their detailed structure is necessary. A suitable rigid plastic material for various components such as front guard 90, front frame 70 and fan blades assembly 50 preferably is ABS resin (an acrylinitrile-butadienestyrene co-polymer), while that for rear guard 40 preferably is polypropylene. Three typical fan motor "M" speeds are, in rpm, "1"-1150; "2"-955, and "3"-720, while the typical rpm for step motor "m" is about 5–6. Further, the maximum overall axial depth of fan F is typically about 9–10 inches, preferably about 9 inches, measured from the base plate to the lower guard inclusive, and when compared to its typical overall diameter of about 18 inches, (the fan blades assembly overall diameter being about 14 inches) this produces a maximum axial depth to diameter ratio of about 5/9 (or 0.56), and a preferred ratio of about ½ (or 0.5). Stated alternatively, the minimum diameter to depth ratio is about 9/5 (or about 1.8), while the preferred ratio is about 2/1 (or 2.0). Thus, for a given overall fan diameter sufficient for adequate air flow volume and cooling area coverage at acceptable fan motor speeds, such as those given above, and tolerable noise levels, such as those produced at such speeds, the axial length or depth of fan F is reduced to the practical minimum, thereby maximizing needed head room.

While the invention has been described and illustrated herein primarily be reference to a single preferred embodiment, this is to be considered as illustrating, rather than as limiting the invention, the scope of which is to be determined by the appended claims.

What is claimed is:

1. An electric ceiling fan including fan motor means and rotatable fan blade means mounted around and adapted to be driven by said motor means, wherein the improvement comprises: wheel-like frame means mounting said motor means; support means adapted to be attached to the ceiling; hangar arm means connecting said support means and said frame means, said support means comprising a circular base plate for direct attachment to the ceiling and a circular adaptor removably connected to said hangar arm means, said base plate and said adaptor each having upper peripheral walls and said base plate further having a lower end wall extending from said base upper peripheral wall, said lower end wall being reduced for nesting within said adaptor upper peripheral wall, and interengageable means for removably securing said adaptor upper peripheral wall against said base plate end wall, said interengageable means including diametrically opposite bayonet slots extending through said adaptor upper peripheral wall and upwardly open outstanding struts having threaded openings formed therethrough depending from said base plate end wall whereby said bayonet slots are rotatingly engageable with said struts, and threaded fastener means passing through said adaptor upper peripheral wall and engageable in said strut openings; air pervious upper guard means mounted on said frame means and enclosing said fan blade means and motor means, while permitting air flow to said fan blade means; step motor means mounted on said frame means; air pervious lower guard means mounted on and adapted to be driven by said step motor means beneath said frame means and including vane means for controlling air flow direction from said fan blade means; and control means adapted to be connected across a power source and including switch means having electrical connections to said fan motor means and step motor means for energizing and deenergizing the same; said fan having a maximum overall axial depth, from said support means to said lower guard means inclusive, of not more than about 10 inches, for maximizing headroom.

2. The fan of claim 1, wherein said fan has an overall diameter to axial depth ratio of not less than about 1.8/1 for adequate air flow volume and cooling area coverage at acceptable fan motor speeds and tolerable noise levels.

3. The fan of claim 1, wherein said maximum overall axial depth is not more than about 9 inches.

4. The fan of claim 3, wherein said fan has an overall diameter to axial depth ratio of about 2/1 for adequate air flow volume and cooling area coverage at acceptable fan motor speeds and tolerable noise levels.

5. The fan of claim 1, wherein said frame means include a central hub, an outer ring, and radial spokes connecting said hub and ring; said hub having a lower end wall and an upper peripheral wall defining a relatively shallow and upwardly open cup-shape receiving said step motor means removably mounted on said end wall; said outer ring supporting said upper guard means and being pivotally connected to said hanger arm means for adjusting the position of said fan relative to the ceiling and thereby vary the general air flow direction.

6. The fan of claim 5, wherein said outer ring is of hollow and upwardly open, generally channel-shaped cross section and includes upstanding internally threaded socket means for engaging threaded fasteners removably securing said upper guard means over the open upper end of said outer ring, and at least one of said spokes housing certain of said electrical connections passing through said upper guard and outer ring to said fan motor means and step motor means.

7. The fan of claim 1, wherein said hanger arm means are of relatively shallow configuration and include a pair of elongated tubular members extending radially outwardly and downwardly from said support means to said frame means.

8. The fan of claim 7, wherein each of said tubular members includes an upstanding flattened upper end removably secured within said support means and a flattened lower end overlapping and removably secured to said frame means.

9. The fan of claim 1, wherein said upper guard means is of relatively shallow configuration and includes a central hub, an outstanding annular flange removably secured to said frame means, and a plurality of closely spaced elongated ribs extending radially outwardly and axially downwardly from said hub to said flanges.

10. The fan of claim 9, wherein said upper guard means includes at least one ring intermediate said hub and flange, and a plurality of shorter ribs extending between said elongated ribs from said ring to said flange.

11. The fan of claim 1, wherein said lower guard means is of thin disk-like configuration and includes a central hub, and an outer ring connected to said hub by certain ones of a series of radially spaced and generally parallel, elongated air flow control vanes spanning opposite inner peripheral portions of said outer ring, and by at least one elongated diametral reinforcing rib extending transversely across said vanes.

12. The fan of claim 11, wherein said frame means include a central hub having a lower end wall and an upper peripheral wall defining a relatively shallow and upwardly open cup-shape; said central hub of said lower guard means includes a disc wall and an upstanding peripheral flange freely nesting around said lower end wall, on which lower end wall is removably mounted said step motor means having a rotatable drive shaft freely passing downwardly through a central opening in said lower end wall; said lower guard means also includes a drive member having a disc washer removably secured on said disc wall and provided with an externally threaded hollow stub shaft passing downwardly through a central opening in said disc wall and receiving said drive shaft, which is removably fixed therein to space said disc washer slightly from said lower end wall for free rotation of said lower guard means relative to said frame means to vary the air flow from said fan blade means through such vanes.

13. The fan of claim 12, wherein said peripheral flange also projects downwardly beyond said disc wall, and said lower guard means also includes a hub cap of shallow and upwardly open cup-shape and provided with an upstanding internally threaded collar engaged over said stub shaft in a direction opposite to the rotation of said lower guard means, for tightening the upper end of said hub cap against said disc wall during such rotation.

14. The fan of claim 11, wherein said frame means include an outer ring having a peripheral wall portion protruding downwardly around a radial wall portion to define a recess in which is freely nested said outer ring of said lower guard means, with the latter ring being provided with peripherally spaced upstanding lugs spaced slightly below said radial wall portion for guiding the rotation of said lower guard means relative to said frame means.

15. The fan of claim 11, wherein said fan motor means rotates said fan blade means at high speed as compared to the low speed of said lower guard means being rotated by said step motor means in the same direction as said fan blade means; with a number of said vanes adjacent one peripheral portion of said outer ring being arranged with their sides extending generally axially to create a generally axial column of air flowing downwardly from said fan blade means, and the remainder of said vanes being arranged with their sides inclined toward the opposite peripheral portion of said outer ring to create a column of air flowing downwardly and outwardly from said fan blade means, with each of said columns slowly revolving to distribute the air over a wider area while eliminating any excessive flow or "dead spots" directly beneath said fan.

16. The fan of claim 15, wherein said opposite peripheral portion of said outer ring is provided on its lower surface with means indicating the position of said inclined vanes and the column of air flowing downwardly and outwardly therefrom.

17. The fan of claim 1, wherein said switch means include a separate switch for energizing and deenergizing said step motor means independently of said fan motor means.

18. The fan of claim 1, wherein said switch means include a multi-position switch for deenergizing said fan motor means and for selectively energizing said fan motor means at different speeds.

19. The fan of claim 1, wherein said control means include a normally closed, thermal switch connected in circuit with both of said motor means, and automatically openable upon a predetermined temperature being reached to deenergize both of said motor means, and thereby prevent overheating thereof.

20. The fan of claim 1, wherein said control means include timer means connected in circuit with said fan motor means and step motor means for deenergizing both of said motor means and for energizing both of said motor means for continuous as well as predetermined periods of operation.

21. The fan of claim 1, wherein said switch means include a separate switch for energizing and deenergizing said step motor means independently of said fan motor means, and a multiposition switch for deenergizing said fan motor means, and for selectively energizing said fan motor means at high, intermediate and low speeds respectively.

22. The fan of claim 21, wherein said control means include a normally closed, thermal switch connected in circuit with said fan motor means and step motor means, and automatically openable upon a predetermined temperature being reached to deenergize both of said motor means, and thereby prevent overheating thereof.

23. The fan of claim 22, wherein said control means include timer means connected in circuit with said fan motor means and step motor means and having timer motor means and selective multi-position timer switch means operatively associated with and drivable by said timer motor means, said timer switch means having one position for deenergizing all three of said motor means, another position for deenergizing said timer motor means while energizing both of said fan motor means and step motor means for continuous operation, and still other positions for energizing all three of said motor means for predetermined periods of operation, until driven by said timer motor means to said one position.

24. The fan of claim 1, wherein said frame means include an outer ring of hollow and upwardly open, generally channel-shaped cross-section and having adjacent each diametrically opposite point of attachment to said hanger arm means, a pair of internal and upstanding, spaced radial walls, a rectangular nut contained transversely between said radial walls against rotation, and a radial bolt passing through said hanger arm means and the outer periphery of said ring into threaded engagement with said nut to mount said frame means on said hanger arm means, for pivotally adjusting the position of said fan relative to the ceiling and thereby vary the general air flow direction.

* * * * *